US012527990B2

(12) United States Patent
Zoffoli et al.

(10) Patent No.: US 12,527,990 B2
(45) Date of Patent: Jan. 20, 2026

(54) METHOD FOR CONTROLLING EXERCISE LOAD VARIATIONS IN A STRENGTH EXERCISE MACHINE AND EXERCISE MACHINE IMPLEMENTING SUCH METHOD

(71) Applicant: TECHNOGYM S.p. A., Cesena (IT)

(72) Inventors: Luca Zoffoli, Cesena (IT); Andrea Budelacci, Cesena (IT)

(73) Assignee: TECHNOGYM S.p. A., Cesena (IT)

( * ) Notice: Subject to any disclaimer, the term of this patent is extended or adjusted under 35 U.S.C. 154(b) by 187 days.

(21) Appl. No.: 17/513,380

(22) Filed: Oct. 28, 2021

(65) Prior Publication Data

US 2022/0134186 A1 May 5, 2022

(30) Foreign Application Priority Data

Oct. 30, 2020 (IT) ..... 102020000025891

(51) Int. Cl.
*A63B 24/00* (2006.01)

(52) U.S. Cl.
CPC ..... *A63B 24/0087* (2013.01); *A63B 24/0062* (2013.01); *A63B 24/0075* (2013.01); *A63B 2220/51* (2013.01)

(58) Field of Classification Search
CPC ..... A63B 24/0087; A63B 24/0062; A63B 24/0075; A63B 2220/51; A63B 23/0494; A63B 23/1254; A63B 23/1272; A63B 2071/0641; A63B 71/0622; A63B 2024/0012; A63B 21/0059; A63B 2220/13; A63B 2220/17; A63B 2220/31; A63B 2220/34; A63B 21/00181; A63B 2024/0093; A63B 2071/065; A63B 21/00076; A63B 21/0628
(Continued)

(56) References Cited

U.S. PATENT DOCUMENTS 5,407,403 A 4/1995 Coleman
5,435,798 A 7/1995 Habing et al.
(Continued)

OTHER PUBLICATIONS

Search Report for IT2020000025891 dated Jul. 24, 2021, The Hague, NL.

*Primary Examiner* — Megan Anderson
*Assistant Examiner* — Jonathan A Dicuia
(74) *Attorney, Agent, or Firm* — ArentFox Schiff LLP; Michael Fainberg

(57) ABSTRACT

A method for controlling exercise load variations in a strength exercise machine, includes, at a current time instant $t_i$, detecting an exercise position within a set range of motion of a user, and checking if a previously set trigger condition of an exercise load variation includes the detected exercise position of the user within the set range of motion. If a previously set trigger condition of an exercise load variation includes the detected exercise position of the user within a respective range of motion, the method includes setting a trigger condition of an exercise load variation as the current trigger condition of exercise load variation having a first speed threshold for execution of motion by the user, and reducing an exercise load based on a comparison of speed for execution of motion by the user and the first speed threshold.

16 Claims, 9 Drawing Sheets

(58) Field of Classification Search
USPC ..... 482/4
See application file for complete search history.

(56) References Cited

U.S. PATENT DOCUMENTS

| | | | | |
|---|---|---|---|---|
| 5,569,120 | A * | 10/1996 | Anjanappa | A63B 24/00 482/4 |
| 6,261,205 | B1 | 7/2001 | Elefson | |
| 9,789,362 | B1 * | 10/2017 | Su | A63B 24/0075 |
| 2014/0274566 | A1 * | 9/2014 | Draper | A63B 24/0062 482/8 |
| 2014/0287876 | A1 * | 9/2014 | Etter | A63B 24/0087 482/5 |
| 2019/0192906 | A1 * | 6/2019 | Smith | G16H 50/30 |
| 2021/0077860 | A1 * | 3/2021 | Posnack | A63B 24/0075 |

* cited by examiner

METHOD FOR CONTROLLING EXERCISE LOAD VARIATIONS IN A STRENGTH EXERCISE MACHINE AND EXERCISE MACHINE IMPLEMENTING SUCH METHOD

CROSS-REFERENCE TO RELATED APPLICATION

This application claims priority to Italian Patent Application No. 102020000025891 filed on Oct. 30, 2020, the entire contents of which is hereby incorporated in its entirety by reference.

FIELD OF THE INVENTION

The present invention relates to the field of fitness, and in particular to a method for controlling exercise load variations in a strength exercise machine and an exercise machine implementing such a method.

BACKGROUND OF THE INVENTION

Among the various types of workouts, the stripping or drop set technique (also known as descending set or strip set technique) is a specific high-intensity strength technique applied in weight training, in particular in bodybuilding and fitness.

Controlling the exercise load applied to the exercise machine is a very important aspect of this type of physical exercise. This is to ensure optimal results, i.e. to maximize strength, while avoiding the use of excessive loads which could be harmful to the user.

The exercise load is typically controlled manually by physically adjusting the number of plates (in the case of exercise machines with a weight stack) or on the number of disks loaded on the barbell or dumbbells used (in the case of workout with free weights). In this case, the user himself/herself must interrupt the exercise to vary the exercise load or request the presence of one or more users or personal trainers to assist him/her during the exercise so as to promptly vary the workload whenever required or needed.

Nowadays, the need is strongly felt for a method for controlling exercise load variations in a strength exercise machine during a workout using the stripping technique which allows varying an exercise load in a strength exercise machine in a reliable and timely manner, thus ensuring that an execution of the workout by a user is as high-performing as possible while being safe.

SUMMARY OF THE INVENTION

It is an object of the present invention to devise and provide a method for controlling exercise load variations in a strength exercise machine during a workout using the stripping technique which allows at least partially obviating the drawbacks claimed above with reference to the prior art, in particular which allows controlling an exercise load variation in a strength exercise machine in a reliable and timely manner, thus ensuring that an execution of the workout by a user is high-performing, convenient, and safe.

Such object is achieved by a method as described and claimed herein.

Preferred embodiments are also described.

The present invention also relates to an exercise machine implementing such method.

BRIEF DESCRIPTION OF THE DRAWINGS

Further features and advantages of the method and such an exercise machine according to the invention will become apparent from the following description of preferred embodiments, given by way of indicative, non-limiting example, with reference to the accompanying drawings.

It is worth noting that, in the aforesaid figures, equivalent or similar elements are indicated by the same numeric and/or alphanumeric references.

DETAILED DESCRIPTION

A strength exercise machine 100 which can be employed by a user to perform physical activity, according to the present invention, will now be described with reference to the aforesaid figures.

A strength exercise machine 100 is any exercise machine in which the user while executing an exercise moves an exercise or work load, thus strengthening the muscles of one or more parts of the body, such as the chest, shoulders, upper limbs, lower limbs, and so on.

Figure 1:
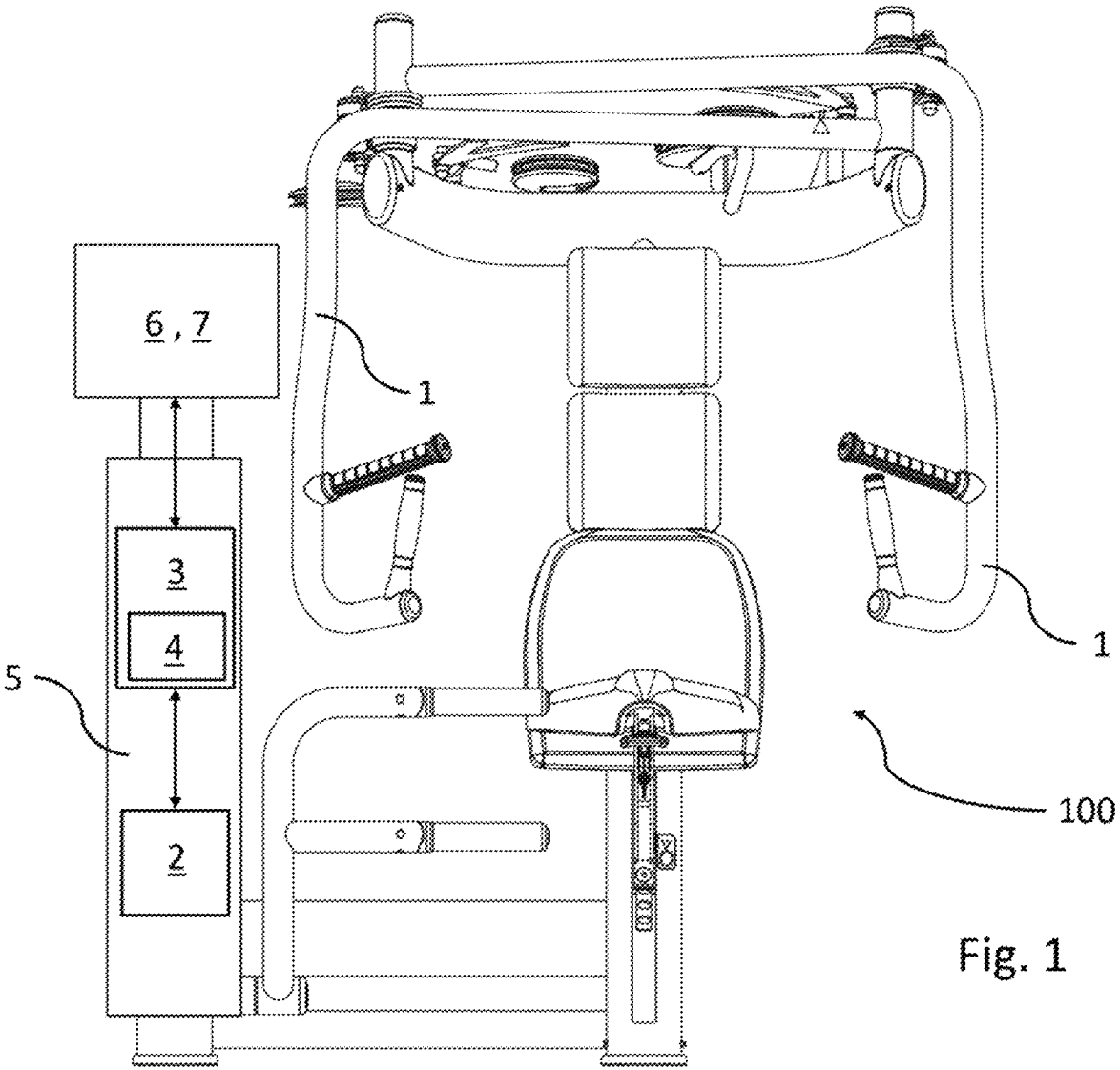
FIG. 1 depicts a strength exercise machine configured to implement the method of controlling exercise load variations in a strength exercise machine according to the present invention.
Figure 2:
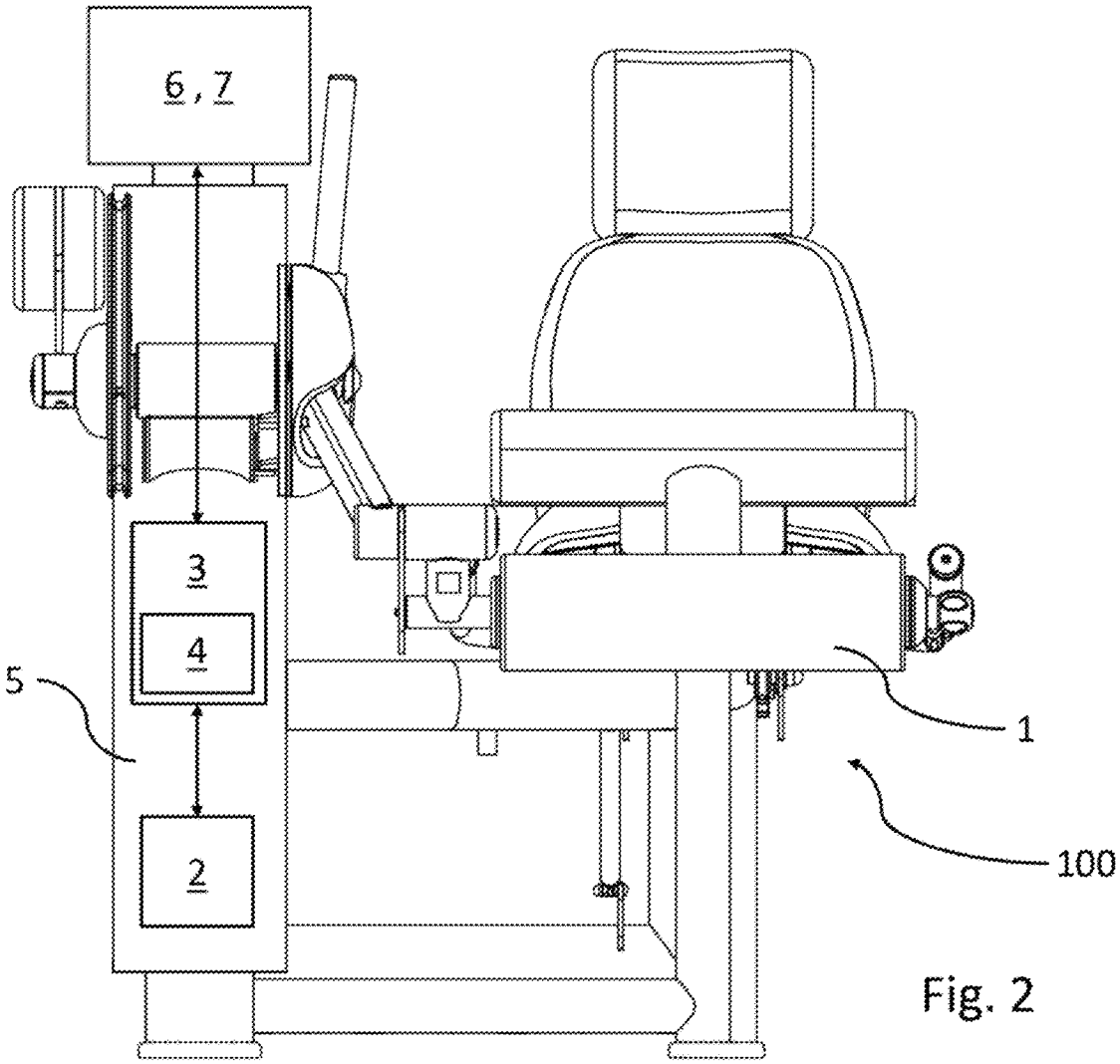
FIG. 2 depicts another strength exercise machine configured to implement the method of controlling exercise load variations in a strength exercise machine according to the present invention.
Figure 3:
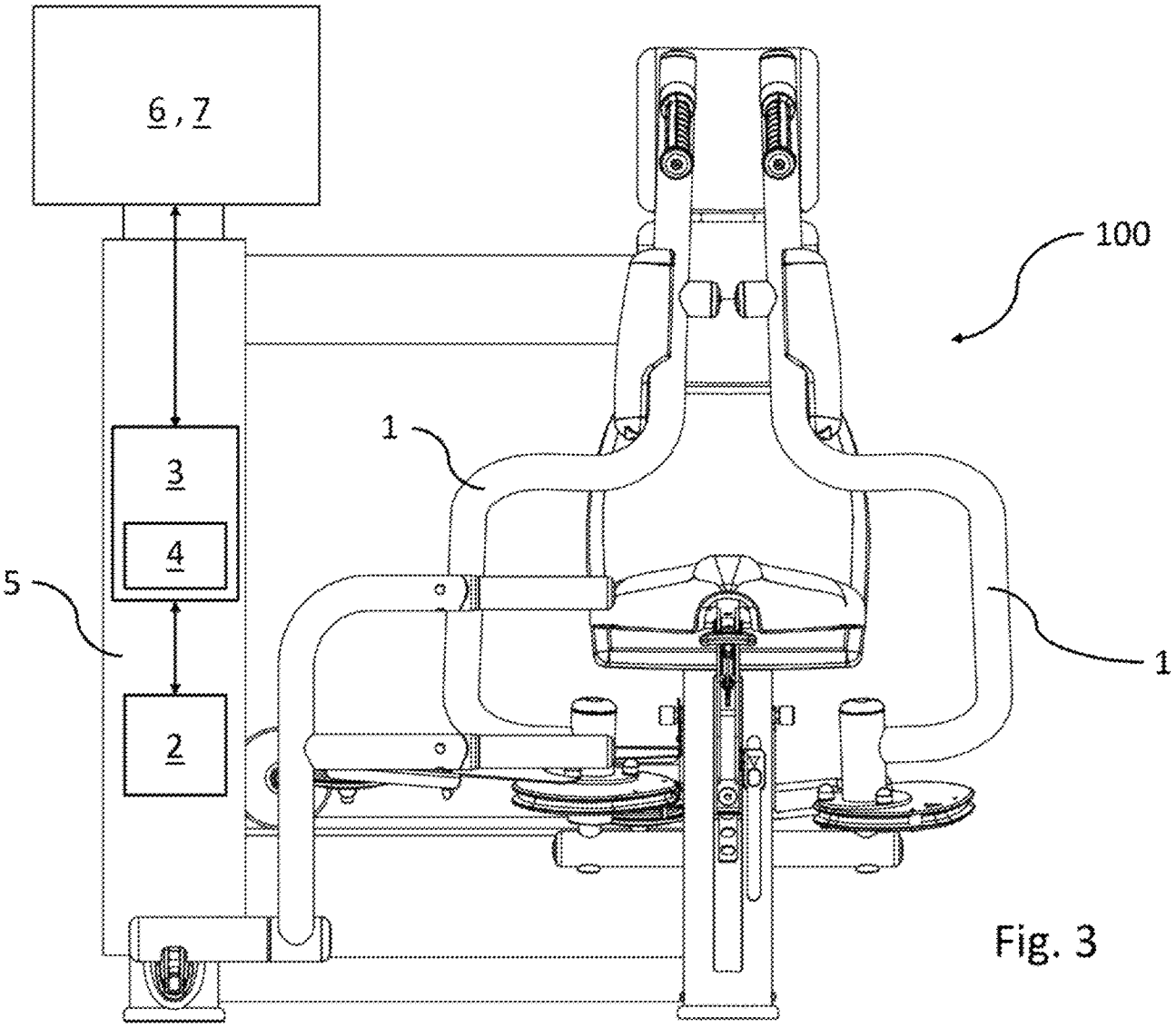
FIG. 3 depicts yet another strength exercise machine configured to implement the method of controlling exercise load variations in a strength exercise machine according to the present invention.

In the example of the figures, there are shown exercise machines for strengthening the upper limbs, i.e. a "chest press" in FIG. 1, a "pectoral machine" in FIG. 3, and an exercise machine for strengthening the lower limbs, i.e. a "leg extension machine" in FIG. 2, respectively.

Referring generally to the aforesaid figures, the strength exercise machine 100 comprises at least one movable element 1 which is operable by a user to execute a strength exercise by moving a respective exercise load.

In particular, the at least one movable element 1 is operable by the user in a first direction of motion (so-called concentric motion), which simulates the lifting of a gravitational load (exercise or work load), and in a second direction of motion (so-called eccentric motion), in the direction opposite to the first direction of motion, which simulates the return of the gravitational load (exercise or work load) to the start position.

It is worth noting that the user, during the actuation of the at least a first movable element 1, can execute a Range Of Motion (ROM).

Such a range of motion, in the first direction of motion (concentric motion) is between a first start position, in which the exercise machine 100, upon the user's action, is configured to begin lifting the exercise load, and a second motion end position, in which the user has moved the at least one movable element 1 against the resistance given by the exercise load.

In an entirely complementary manner, the range of motion, in the second direction of motion (eccentric motion) is between the second motion end position and the first start position, in which the exercise machine 100, upon the user's action, is configured to begin lifting the exercise load.

In the example in FIGS. 1 and 3, the at least one movable element 1 is a first lever, which is operable by a first upper limb of the user.

In this example, the exercise machine 100 further comprises at least a second lever, again indicated by reference numeral 1, which is operable by a second upper limb of the user.

In the example in FIG. 2, the at least one movable element 1 is an additional lever which is operable by both lower limbs of the user.

Again, generally referring to FIGS. 1-3, the strength exercise machine 100 further comprises at least one motor 2 (diagrammatically shown in the figures) operatively connected, e.g., through mechanical kinematic mechanisms, to the at least one movable element 1.

The at least one motor 2 is configured to exert, on the at least one movable element 1, a resistive force representative of an exercise load which the user may move during the execution of the exercise by actuating the at least one movable element 1.

The at least one motor 2 is any motor the control of which allows such a resistant force to be applied, such as an electric motor, an electromagnetic motor, and so on.

The strength exercise machine 100 further comprises a data processing unit 3, e.g. a microprocessor or a microcontroller.

The data processing unit 3 is operatively connected to said at least one electric motor 2.

Furthermore, the strength exercise machine 100 comprises a memory unit 4 operatively connected to the data processing unit 3.

The memory unit 4 may be inside (as diagrammatically shown in FIGS. 1-3) or outside the data processing unit 3 (embodiment not shown in the figures).

The data processing unit 3 is configured to control the exercise machine 100 by loading and executing one or more program codes stored in the memory unit 4.

In particular, the data processing unit 3 is configured to control the at least one motor 2.

In greater detail, the data processing unit 3 is configured to execute a method for controlling exercise load variations in the strength exercise machine 100 during a workout, by a user, using the stripping technique, as will be described below.

The known stripping or drop set technique (also known as descending set or strip set technique) is a specific high-intensity strength or muscle-building technique applied in resistance training.

Returning to the strength exercise machine 100 in FIGS. 1-3, in an embodiment, such an exercise machine 100 further comprises a housing 5 in which the at least one electric motor 2, the data processing unit 3, and the memory unit 4 are housed.

Again, with reference to FIGS. 1-3, in an embodiment, in combination with any of those described above, the exercise machine 100 further comprises a user interface 6 operatively connected to the data processing unit 3.

In this regard, it is worth noting that the data processing unit 3 is further configured to control the strength exercise machine 100 based on commands imparted by the user through the user interface 6.

In an embodiment, the user interface 6 may be of the touchscreen type.

In a further embodiment, alternative to the preceding one, the user interface 6 may be a push-button keyboard.

In an embodiment, shown in the figures, the user interface 6 is installed on the housing 5.

In an embodiment, in combination with any of those described above, shown in any one of FIGS. 1-3, the strength exercise machine 100 further comprises a display module 7 operatively connected to the data processing unit 3.

The display module 7 can be employed by the user during the interaction with the user interface 6.

Indeed, the display module 7 is configured to show to the user contents representative of the use of the strength exercise machine 100, e.g., identification screen, initial menu screen for setting up the workout, screen with parameters and/or graphics being updated while the exercise is being executed, workout summary screen, and so on.

Examples of screens which can be displayed by the display module 7 will be described below with reference to FIGS. 4*a*-4*i*.

Turning back again to FIGS. 1-3, in an embodiment, in which the user interface 6 is of the touchscreen type, the display module 7 may coincide with the user interface 6.

It is worth noting that in this embodiment, the display module 7 is configured to show the user interface 6 to the user, in addition to contents representative of the use of the strength exercise machine 100 (examples of which have been provided above).

According to a further embodiment, alternative to the preceding one and not shown in the figures, the display module 7 is instead separate from the control interface 6.

Returning in general to the strength exercise machine 100 according to the present invention, the data processing unit 3, during a workout using the stripping technique by a user, at a current time instant $t_i$ of a plurality of successive time instants $t_1, t_2, \ldots, t_N$, where $1<i<N$, is configured to execute the operations which will be described below.

As for the plurality of time instants $t_1, t_2, \ldots, t_N$, it is worth noting that the time distance between the aforesaid time instants depends on the sampling frequency with which the data processing unit 3 of the exercise machine 100 is configured in order to execute such operations.

In an embodiment, the data processing unit 3 is configured to detect an exercise position within a set range of motion of the user.

Such an operation is executed with the aid of a position sensor installed on the strength exercise machine 100.

In an embodiment, in combination with the preceding one, the data processing unit 3 is configured to define such an exercise position within the set range of motion of the user as a percentage value of the set range of motion of the user.

In an embodiment, the data processing unit 3 is configured to check if a previously set trigger condition of an exercise load variation comprises the detected exercise position of the user within the set range of motion.

By way of example:

- a first trigger condition of an exercise load variation may comprise, as a rule, that the exercise position of the user has a percentage value of the set range of motion of the user between 0% and 20% of the set range of motion of the user; and
- a second trigger condition of an exercise load variation may comprise that the exercise position of the user has a percentage value of the set range of motion of the user between 21% and 85% of the set range of motion of the user.

If the previously set trigger condition of an exercise load variation comprises the detected exercise position of the user within the respective range of motion, the data processing unit 3 is configured to set such a trigger condition of an exercise load venation as the current trigger condition of an exercise load variation.

Such a trigger condition of an exercise load variation comprises at least one respective first speed threshold for the execution of the motion by the user.

Furthermore, again if the previously set trigger condition of an exercise load variation comprises the exercise position of the user within the respective detected range of motion, the data processing unit 3 is configured to compare a speed for the execution of the motion by the user at the current time instant $t_i$ with the first speed threshold for the execution of the motion by the user comprised in the trigger condition of an exercise load variation.

It is worth noting that the speed for the execution of the motion by the user is preferably a displacement speed of the at least one movable element 1 of the strength exercise machine 100 moved by the user.

A displacement speed corresponds to an angular speed of the at least one electric motor 2, and by virtue of a correlation table between displacement speed and angular speed, the data processing unit 3, based on the calculated angular speed of the at least one electric motor 2 (e.g., by deriving it from the exercise position detected by the position sensor), is also able to know the displacement speed of the at least one movable element 1 moved by the user.

In this embodiment, if the speed for the execution of the motion by the user is either less than or equal to the first execution speed threshold, the data processing unit 3 is configured to reduce the exercise load by a set exercise load variation associated with the number of exercise load variations executed by the data processing unit 3 of the strength machine 100 up to the current time instant $t_i$.

By way of example:

- a first trigger condition of an exercise load variation may comprise, as a rule, that the angular speed of the at least one electric motor 2, corresponding to a respective value of the speed for the execution of the motion by the user, is either less than or equal to a first execution speed threshold of 0.3 rad/s; and
- a second trigger condition of an exercise load variation may comprise, as a rule, that the angular speed of the at least one electric motor 2, corresponding to a respective value of the speed for the execution of the motion by the user, is either less than or equal to a first execution speed threshold of 0.9 rad/s.

In an embodiment, in combination with the preceding one, the data processing unit 3 is configured to detect the direction of motion of the user during the exercise.

As previously mentioned, the direction of motion of the user can be a concentric motion, in which the lifting of a gravitational load (exercise or work load) is simulated, and a second direction of motion (so-called eccentric motion), in the opposite direction to the first direction of motion, in which the return of the gravitational load (exercise or work load) to the start position is simulated.

In this embodiment, the data processing unit 3 is configured to check if a previously set trigger condition of an exercise load variation further comprises the detected direction of motion of the user during the exercise.

In this embodiment, the data processing unit 3 is configured to reduce the exercise load by a set exercise load variation associated with the number of exercise load variations executed by the data processing unit 3 of the exercise machine 100 up to the current time instant $t_i$, if the previously set trigger condition of an exercise load variation comprising the exercise position of the user within the respective detected range of motion further comprises the detected direction of motion of the user during the exercise.

By way of example, a first trigger condition may provide that a reduction in the exercise load occurs if:

- the direction of motion by the user is concentric;
- the exercise position of the user has a percentage value of the set range of motion of the user between 0% and 20% of the set range of motion of the user; and
- the angular speed of the at least one electric motor 2, corresponding to a respective value of speed for the execution of the motion by the user, is either less than or equal to a first execution speed threshold of 0.3 rad/s.

Again, by way of example, a second trigger condition may provide that a reduction in exercise load occurs if:

the direction of motion by the user is concentric;

the exercise position of the user has a percentage value of the set range of motion of the user between 21% and 85% of the set range of motion of the user; and the angular speed of the at least one electric motor 2, corresponding to a respective value of speed for the execution of the motion by the user, is either less than or equal to a first execution speed threshold of 0.9 rad/s.

In an embodiment, in combination with any of those described above, the trigger condition of a current exercise load variation further comprises at least one respective second time threshold.

In this embodiment, if the speed for the execution of the motion by the user is either less than or equal to the first execution speed, the data processing unit 3 is configured to check for how much time the speed for the execution of the motion by the user is either less than or equal to the first execution speed threshold by comparing a first comparison time interval between the current time instant $t_i$ and a last preceding time instant $t_{i-k}$, $0<k<i$, where the trigger condition for which the speed for the execution of the motion by the user is either less than or equal to the first execution speed threshold is not met, with a second reference time interval with a duration equal to the second time threshold of the trigger condition.

In this embodiment, the data processing unit 3 is configured to reduce the exercise load by a set exercise load variation associated with the number of exercise load variations executed by the data processing unit 3 of the exercise machine 100 up to the preceding time instant $t_{i-1}$, if the speed for the execution of the motion by the user is either less than or equal to the first execution speed threshold and the first comparison time interval between the current time instant $t_i$ and the last preceding time instant $t_{i-k}$, $0<k<i$ is either greater than or equal to the second time interval with a duration equal to the second time threshold of the trigger condition.

By way of example:

a first trigger condition of an exercise load variation may comprise, as a rule, that the angular speed of the at least one electric motor 2, corresponding to a respective value of the speed for the execution of the motion by the user, is either less than or equal to a first execution speed threshold of 0.3 rad/s, for a time longer than 1 s (first interval of comparison time either greater than or equal to 1 s); and a first second condition of an exercise load variation may comprise, as a rule, that the angular speed of the at least one electric motor 2, corresponding to a respective value of the speed for the execution of the motion by the user, is either less than or equal to a first execution speed threshold of 0.9 rad/s, for a time longer than 0.5 s (first interval of comparison time either greater than or equal to 0.5).

In an embodiment, in combination with the preceding one, if the first comparison time interval is either greater than or equal to the second reference time interval with a duration equal to the second time threshold of the trigger condition, the data processing unit 3 is configured to compare the number of repetitions executed by the user up to the current time instant $t_i$ with a number of repetitions corresponding to the last executed exercise load variation.

In this embodiment, if the number of repetitions executed by the user up to the current time instant $t_i$ is greater than the number of repetitions corresponding to the last executed load variation, the data processing unit 3 is configured to update the number of repetitions corresponding to the last load variation executed with the number of repetitions executed by the user up to the current time instant $t_i$.

In an embodiment, in combination with the preceding one, the data processing unit 3 is configured to compare the number of exercise load variations executed up to the current time instant $t_i$ with a number of exercise load variations to be executed.

In this embodiment, the data processing unit 3 is configured to reduce the exercise load by a set exercise load variation associated with the number of exercise load variations executed by the data processing unit 3 of the strength exercise machine 100 up to the current time instant $t_i$, if the number of exercise load variations executed up to the current time instant $t_i$ is lower than the number of exercise load variations to be executed.

In an embodiment, in combination with the preceding one, the data processing unit 3 is configured, if the number of repetitions executed by the user up to the current time instant $t_i$ is equal to the number of repetitions corresponding to the last executed load variation, to compare a further first comparison time interval between the current time instant $t_i$ and a last preceding time instant $t_{i-k}$, $0<k<i$, with a limit value representative of the maximum time that a trigger condition of an exercise load variation may exist before an exercise load variation occurs.

In this embodiment, the data processing unit 3 is configured to reduce the exercise load by a set exercise load variation associated with the number of exercise load variations executed by the data processing unit 3 of the exercise machine 100 up to the current time instant $t_i$ if the further first comparison time interval is either greater than or equal to the limit value representative of the maximum time that a trigger condition of an exercise load variation may exist before an exercise load variation occurs.

In an embodiment, in combination with any of those described above, the data processing unit 3 is configured to compare the current exercise load with the preceding exercise load detected at a preceding time instant $t_{i-1}$ with respect to the current time instant $t_i$.

In this embodiment, the data processing unit 3 is configured to execute the operations described hereto, according to various embodiments, starting from detecting an exercise position within a set range of motion of the user if the preceding exercise load is equal to the current exercise load.

According to an embodiment, in combination with any of those described above, the data processing unit 3 is configured to increase the exercise load by a set amount as a function of a set increase rule.

It is worth noting that the data processing unit 3 is configured to execute such an increase only before executing the first exercise load reduction by a set exercise load variation. From that point forward, the data processing unit 3 is configured to execute the exercise load variation control as described above according to various embodiments.

According to an embodiment, in combination with the preceding one, the set increase rule provides for increasing the exercise load by the set quantity at the beginning of each repetition or at the beginning of each set time interval (e.g. every 10 seconds).

In an embodiment, in combination with any of the preceding ones, the data processing unit 3 is configured to acquire a first parameter representative of a Range Of Motion (ROM) of the user on that strength exercise machine 100 and a second parameter representative of a maximum load which can be moved by the user in a single repetition or 1RM (1-Repetition Maximum).

In an embodiment, in combination with the preceding one, the data processing unit 3 is configured to set an initial exercise load value.

In this embodiment, the initial exercise load value is defined as a percentage of the first parameter representative of a maximum load which can be moved by the user in a single repetition or 1RM (1-Repetition Maximum), e.g., equal to 80% of the 1-RM of the user.

According to a further embodiment, in combination with any one of the preceding ones, the data processing unit 3 is configured to set initial exercise parameters of the user.

Such initial parameters comprise:

- the maximum number of exercise load variations which may be executed, e.g., 3;
- the set exercise load variation to be executed when a trigger condition of an exercise load variation occurs, e.g., a reduction of 20% with respect to the current working load; such a set exercise load variation being fixed or variable at each reduction to be executed;
- the number of repetition series to be executed, e.g., 2; and
- the recovery time between one repetition and the successive one, e.g., 2 minutes.

According to an embodiment, in combination with any of those described above, the data processing unit 3 is configured to display graphic screens representative of the exercise being executed by the user on the display module 7 of the strength exercise machine 100.

In greater detail, the data processing unit 3 is configured to provide graphic animations of such graphic screens while executing the method of controlling an exercise load variation according to the present invention.

With reference to FIGS. 4*a*-4*i*, each graphic screen which is displayable on the display module 7 of the strength exercise machine 100 comprises:

- a first information representative of the workout time TA, preferably expressed in seconds;
- a second information representative of the current exercise load CC, preferably expressed in kg;
- a third information representative of the current number of executed repetitions RP;
- a first indicator V1 of the maximum number of executable exercise load variations, arranged on both sides of the screen. The first indicator V1 comprises a plurality of graphic elements (e.g., rectangles), the number of which is equal to the maximum number of executable exercise load variations;
- a first graphic element P1 (e.g., a circle), preferably arranged in the center at the bottom of the screen, representative of a first initial exercise position of the set range of motion ROM of the user; and
- a second graphic element P2 (e.g., a circle), preferably arranged in the center at the top of the screen, representative of a second end exercise position of the set range of motion ROM of the user.

Each screen further comprises a movable bar BM, preferably horizontal, adapted to slide between the first graphic element P1 and the second graphic element P2 to simulate the motion of the user during the actuation of the at least one movable element 1 of the strength exercise machine 100 to execute a single repetition.

The movable bar BM is adapted to slide from the first graphic element P1 to the second graphic element P2 during the execution of the exercise by the user in the first direction of motion (concentric motion) and from the second graphic element P2 to the first graphic element P1 during the execution of the exercise by the user in the second direction of motion (eccentric motion).

The movable bar BM comprises a third graphic element P3, e.g., a circle, representative of the exercise position of the user within the set range of motion during the execution of a single repetition by the user.

The movable bar BM further comprises, arranged on both sides of the movable bar BM, a second indicator V2 representative of the current exercise load which can be moved by the user with the actuation of the at least one movable element 1 of the strength exercise machine 100 in a single repetition.

In greater detail, the second indicator V2 comprises a plurality of graphic elements (e.g., rectangles), the number of which is equal to the maximum number of executable exercise load variations, thus also equal to the number of graphic elements of the first indicator V1 (described above).

Figure 4A:
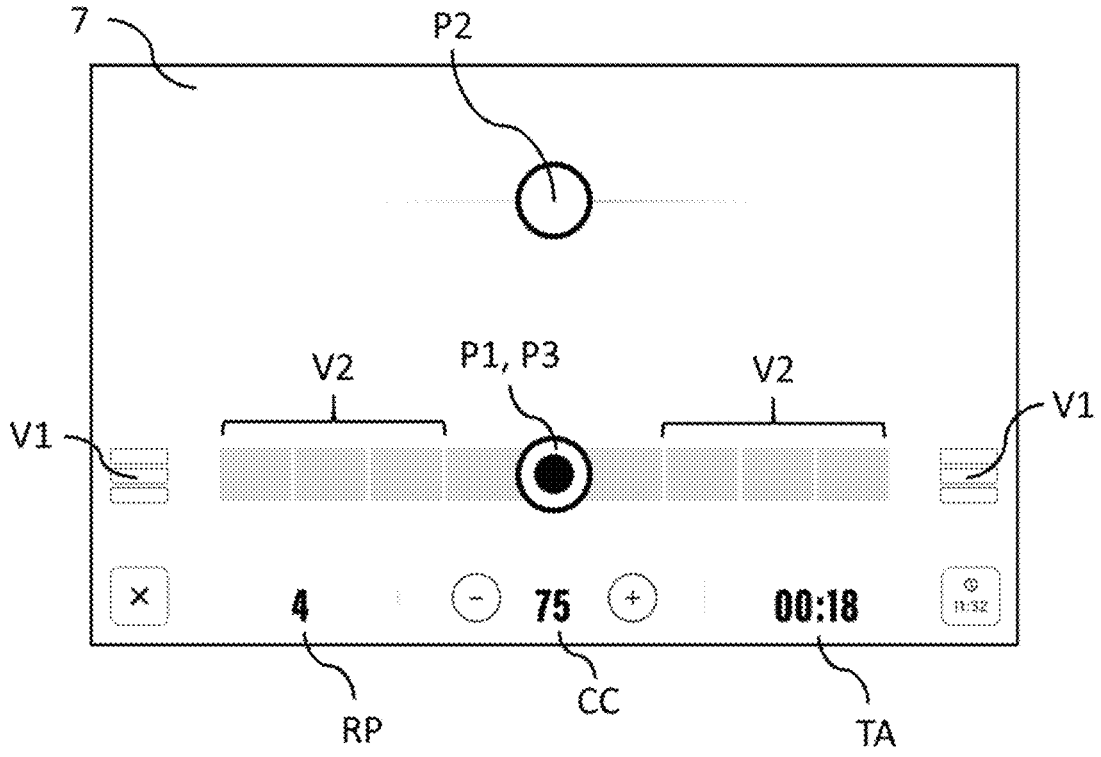
FIG. 4*a* depicts a first graphic screen which can be displayed by a display module of a strength exercise machine implementing the method for controlling exercise load variations in a strength exercise machine according to the present invention, during the execution of such a method.
Figure 4B:
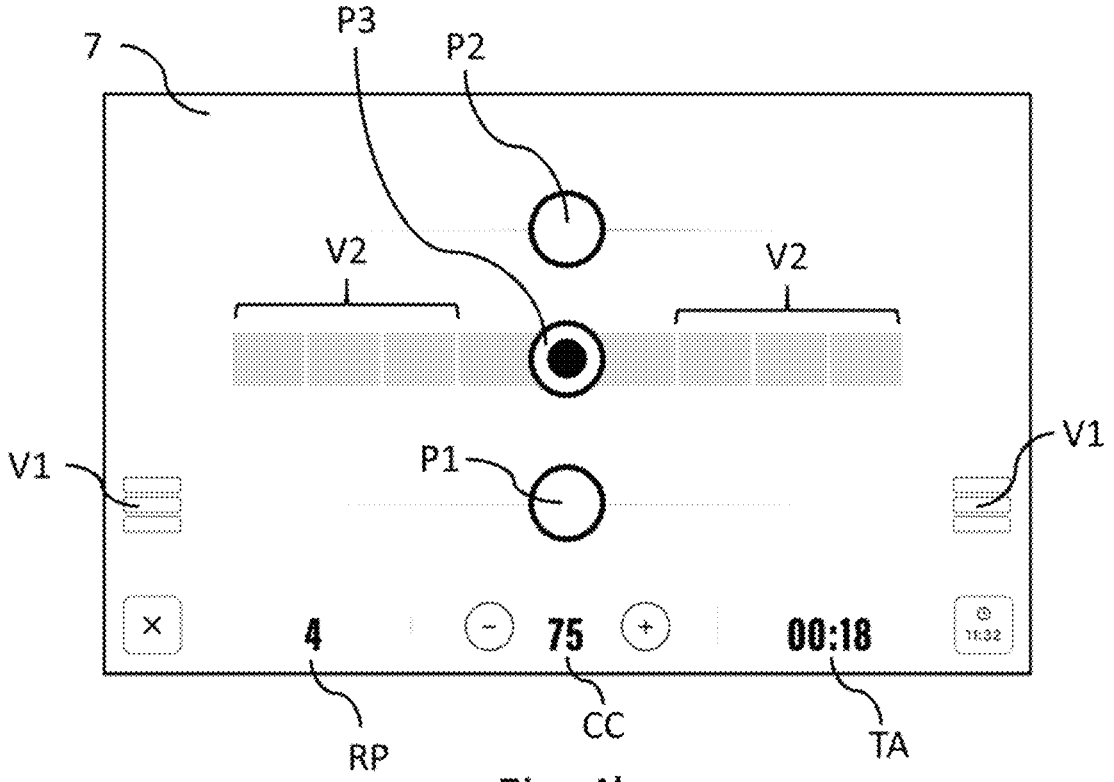
FIG. 4*b* depicts a second graphic screen which can be displayed by a display module of a strength exercise machine implementing the method for controlling exercise load variations in a strength exercise machine according to the present invention, during the execution of such a method.
Figure 4C:
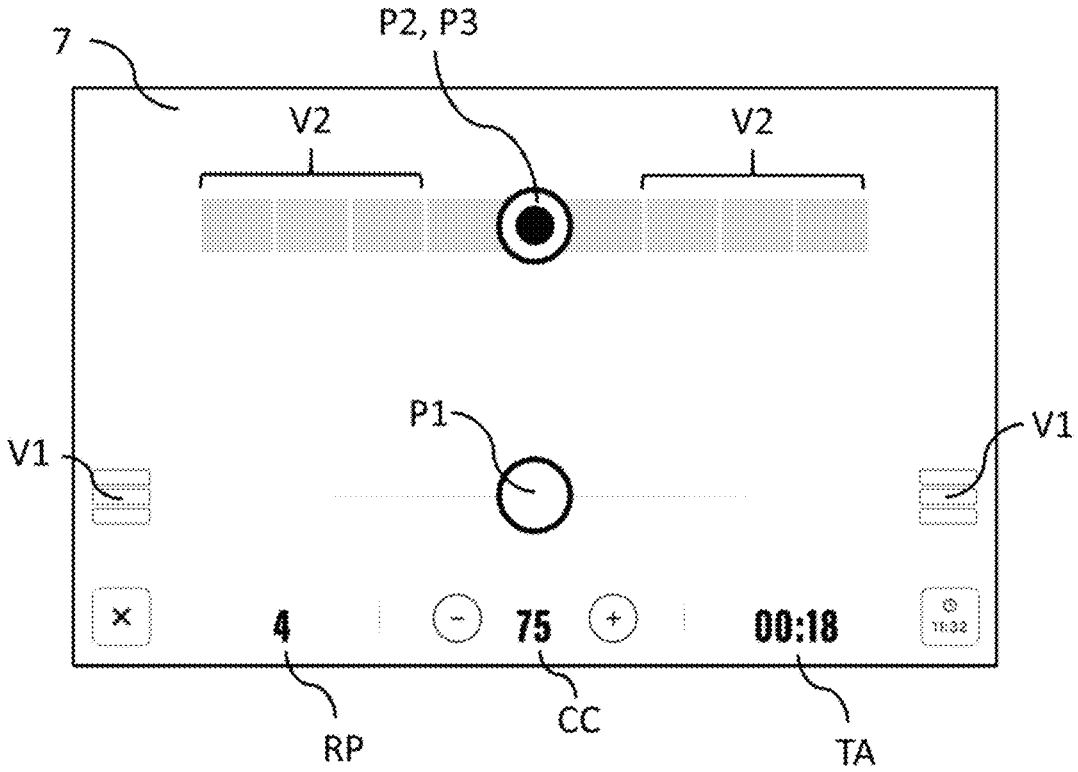
FIG. 4*c* depicts a third graphic screen which can be displayed by a display module of a strength exercise machine implementing the method for controlling exercise load variations in a strength exercise machine according to the present invention, during the execution of such a method.

In FIGS. 4*a*-4*c*, the current exercise load corresponds to the initial exercise load, e.g., 75 kg, set by the data processing unit 3.

In this condition:

- the second indicator V2 of the movable bar BM comprises the whole plurality of graphic elements, corresponding to the maximum number of executable exercise load variations (e.g., three), colored in the same first color (e.g., gray) because no exercise load variation has yet been ordered by the data processing unit 3; and
- the first indicator V1 comprises instead the whole plurality of graphic elements, corresponding to the maximum number of executable exercise load variations (e.g., three), colored in the same second color (e.g., white) because no exercise load variation has yet been ordered by the data processing unit 3.

FIGS. 4*a*-4*c* depict a representative sequence of a single repetition executed by the user with an exercise load equal to the initial exercise load, e.g., 75 kg, set by the data processing unit 3.

FIG. 4*a* depicts the current exercise position (third graphic symbol P3) coinciding with the initial exercise position (first graphic element P1) of the set range of motion ROM of the user (repetition start without yet any extension of the body by the user).

FIG. 4*b* depicts the current exercise position (third graphic symbol P3) coinciding with an intermediate position between the first initial exercise position (first graphic element P1) of the set range of motion ROM of the user and the second end exercise position (second graphic element P2) of the set range of motion ROM of the user (repetition being executed without yet having reached the maximum extension of the body by the user).

FIG. 4*c* depicts the current exercise position (third graphic symbol P3) coinciding with the second end exercise position (second graphic element P2) of the set range of motion ROM of the user (repetition being executed with the maximum extension of the body reached by the user).

Figure 4D:
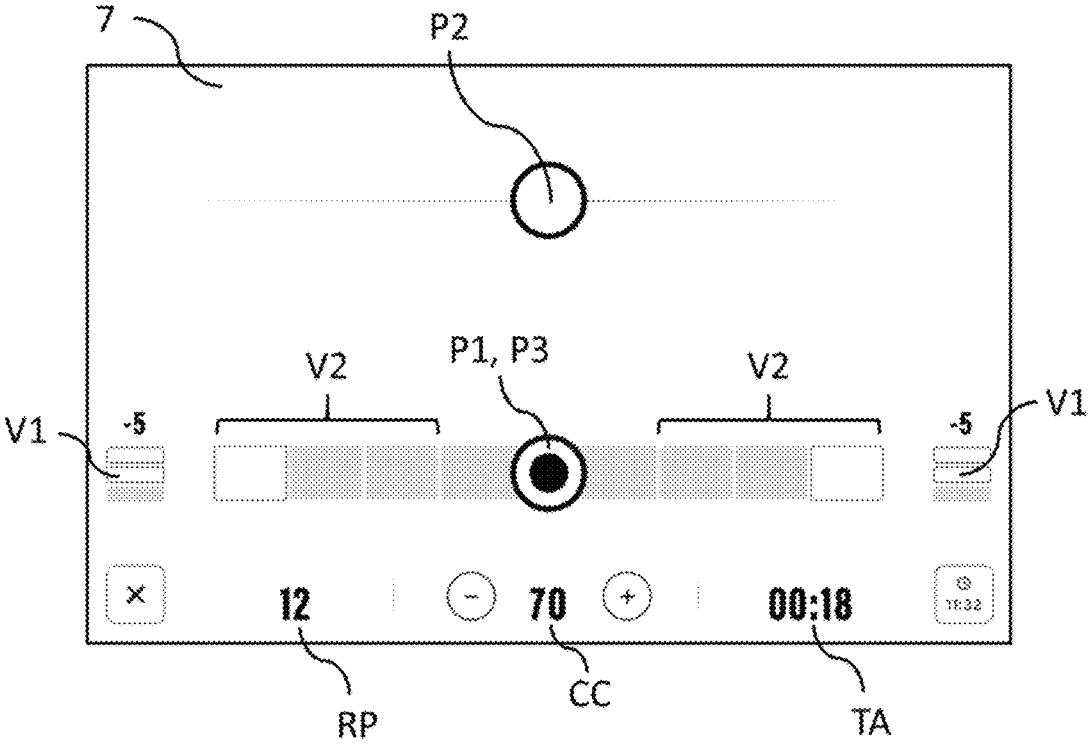
FIG. 4*d* depicts a fourth graphic screen which can be displayed by a display module of a strength exercise machine implementing the method for controlling exercise load variations in a strength exercise machine according to the present invention, during the execution of such a method.
Figure 4E:
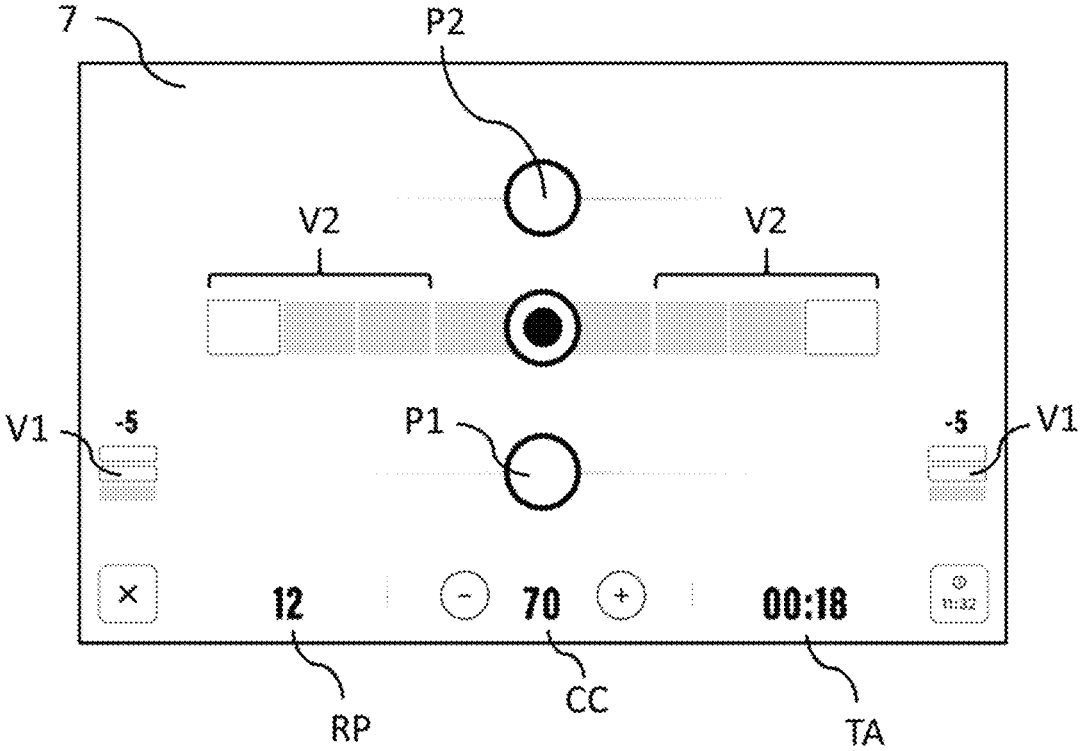
FIG. 4*e* depicts a fifth graphic screen which can be displayed by a display module of a strength exercise machine implementing the method for controlling exercise load variations in a strength exercise machine according to the present invention, during the execution of such a method.
Figure 4F:
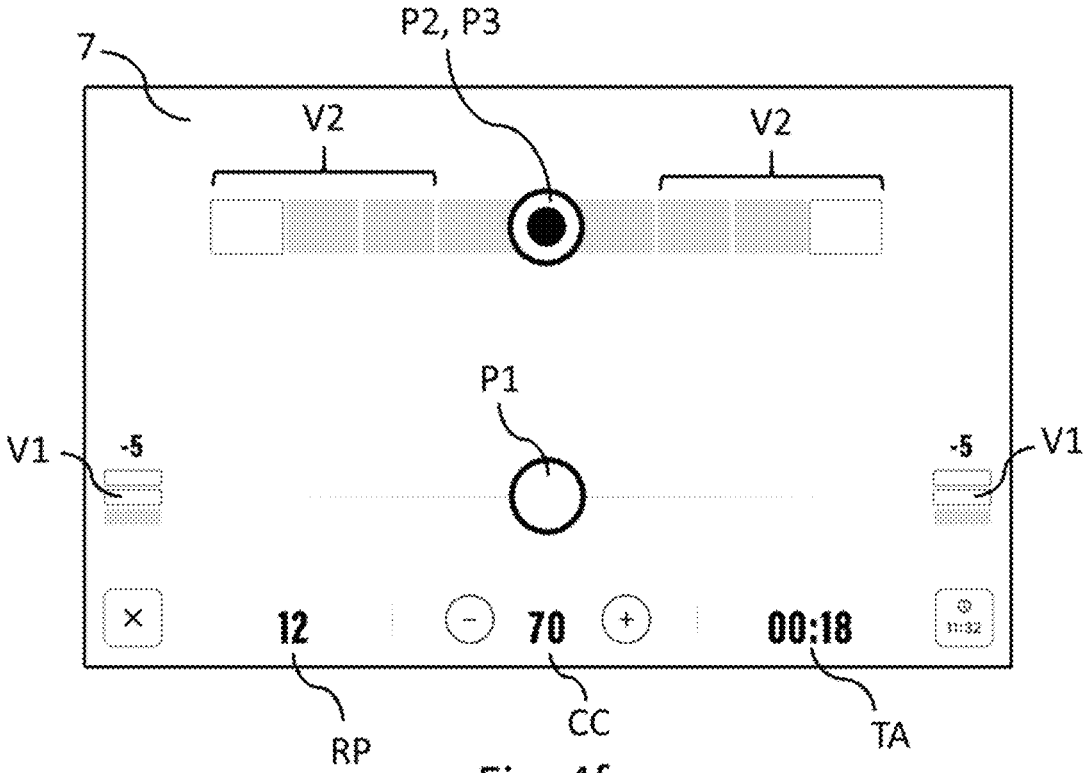
FIG. 4*f* depicts a sixth graphic screen which can be displayed by a display module of a strength exercise machine implementing the method for controlling exercise load variations in a strength exercise machine according to the present invention, during the execution of such a method.

In FIGS. 4*d*-4*f*, the current exercise load, e.g., 70 kg, is obtained by reducing the preceding exercise load by a set exercise load variation, e.g., 5 kg, on command of the data processing unit 3 upon the occurrence of a trigger condition (described above).

In this condition:

- the second indicator V2 of the movable bar BM comprises the plurality of graphic elements corresponding to the maximum number of executable exercise load variations (e.g., three) in which a first portion of graphic elements (in this case, two graphic elements) is colored in the first color (e.g., gray) while a second portion (in this case, one) is colored in the second color (e.g., white) because a reduction of the preceding exercise load by a set exercise load variation of 5 kg, in this example, has been ordered by the data processing unit 3, taking the current exercise load to the value of 70 kg; and the second indicator V1 comprises instead the plurality of graphic elements corresponding to the maximum number of executable exercise load variations (e.g., three) in which a first portion of graphic elements (in this case, two graphic elements) is colored in the second color (e.g., white) while a second portion (in this case, one) is colored in the first color (e.g., gray) because a reduction of the preceding exercise load by a set exercise load variation of 5 kg, in this example, has been ordered by the data processing unit 3, taking the current exercise load to the value of 70 kg.

FIGS. 4*d*-4*f* depict a representative sequence of a single repetition executed by the user with a current exercise load obtained by reducing the preceding exercise load by a set physical exercise load variation.

FIG. 4*d* depicts the current exercise position (third graphic symbol P3) coinciding with the initial exercise position (first graphic element P1) of the set range of motion ROM of the user (repetition start without yet any extension of the body by the user).

FIG. 4*e* depicts the current exercise position (third graphic symbol P3) coinciding with an intermediate position between the first initial exercise position (first graphic element P1) of the set range of motion ROM of the user and the second end exercise position (second graphic element P2) of the set range of motion ROM of the user (repetition being executed without yet having reached the maximum extension of the body by the user).

FIG. 4*f* depicts the current exercise position (third graphic symbol P3) coinciding with the second end exercise position (second graphic element P2) of the set range of motion ROM of the user (repetition being executed with the maximum extension of the body reached by the user).

Figure 4G:
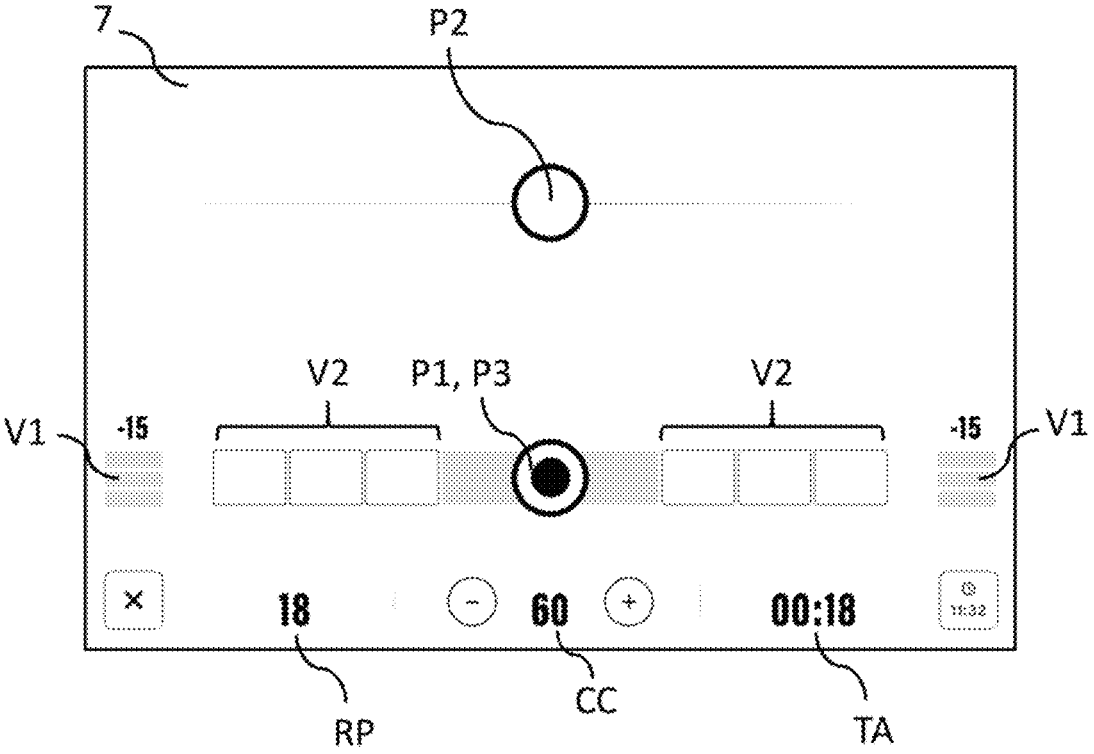
FIG. 4*g* depicts a seventh graphic screen which can be displayed by a display module of a strength exercise machine implementing the method for controlling exercise load variations in a strength exercise machine according to the present invention, during the execution of such a method.
Figure 4H:
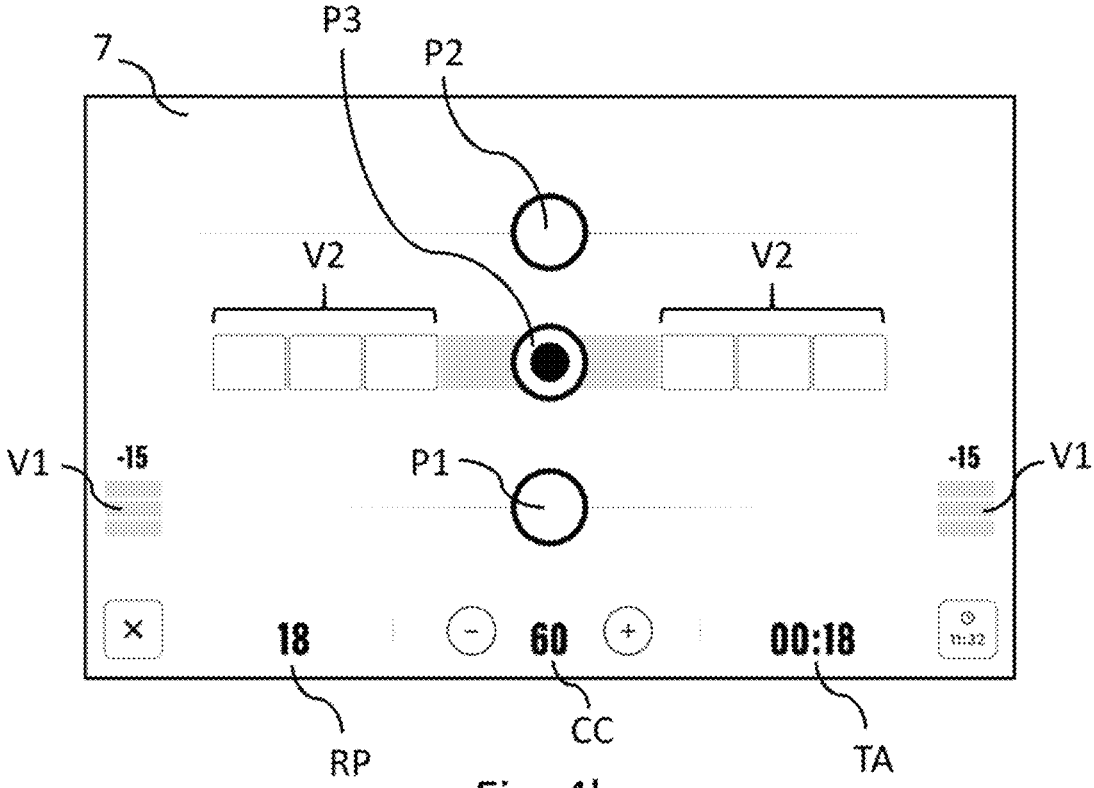
FIG. 4*h* depicts an eighth graphic screen which can be displayed by a display module of a strength exercise machine implementing the method for controlling exercise load variations in a strength exercise machine according to the present invention, during the execution of such a method.
Figure 4I:
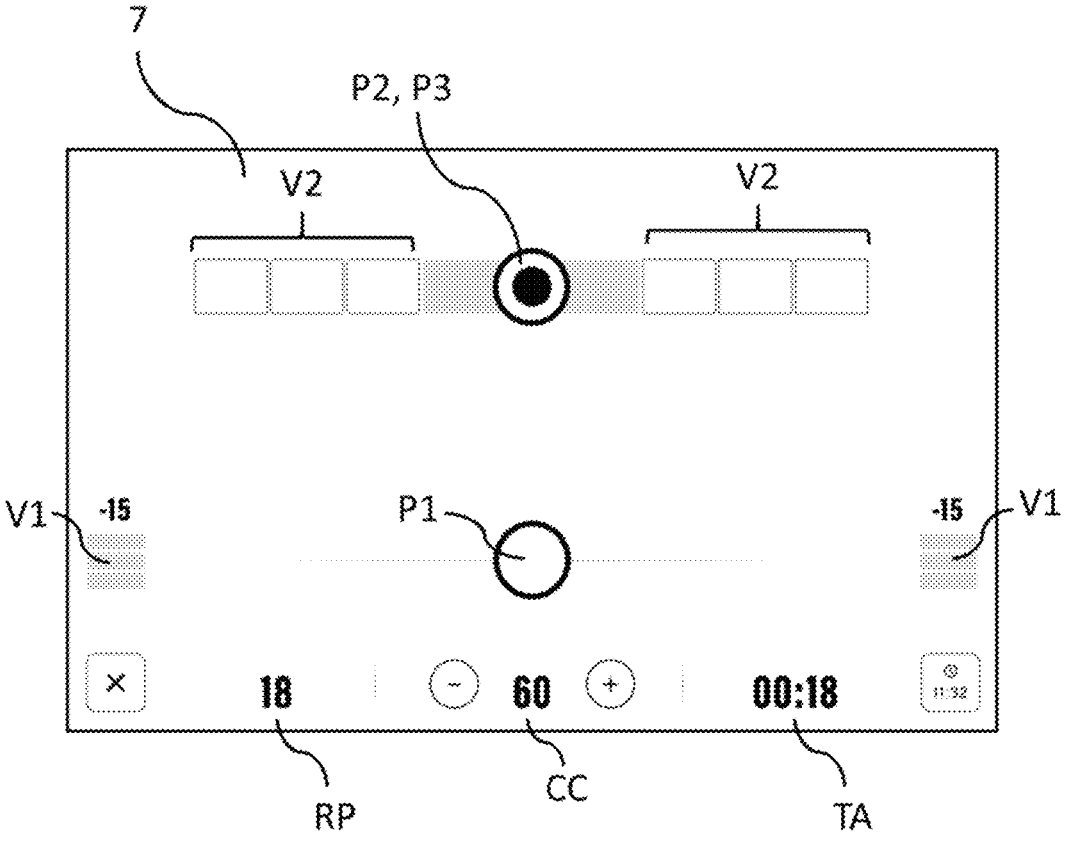
FIG. 4*i* depicts a ninth graphic screen which can be displayed by a display module of a strength exercise machine implementing the method for controlling exercise load variations in a strength exercise machine according to the present invention, during the execution of such a method.

In FIGS. 4*g*-4*i*, the current exercise load, e.g., 60 kg, is obtained by reducing the preceding exercise load by a set exercise load variation, e.g., for a total of 10 kg, on command of the data processing unit 3 upon the occurrence of a trigger condition (described above), consuming the maximum number of executable exercise load variations.

In this condition:

the second indicator V2 of the movable bar BM comprises the plurality of graphic elements, corresponding to the maximum number of executable exercise load variations (e.g., three) in which all graphic elements are colored in the second color (e.g., white) because a reduction of the preceding exercise load by a first and a second further set exercise load variation was ordered by the data processing unit 3 equal to 5 kg, for a total of 10 kg, taking the current exercise load to the value of 60 kg, consuming the maximum number of executable exercise load variations; and the first indicator V1 instead comprises the plurality of graphic elements, corresponding to the maximum number of executable exercise load variations (e.g., three) in which all graphic elements are colored in the second color (e.g., gray) because a reduction of the preceding exercise load by a first and a second further set exercise load variation was ordered by the data processing unit 3 equal to 5 kg, for a total of 10 kg, taking the current exercise load to the value of 60 kg, consuming the maximum number of executable exercise load variations.

FIGS. 4*g*-4*i* depict a representative sequence of a single repetition executed by the user with a current exercise load obtained by consuming the maximum number of executable exercise load variations.

FIG. 4*g* depicts the current exercise position (third graphic symbol P3) coinciding with the first initial exercise position (first graphic element P1) of the set range of motion ROM of the user (repetition start without yet any extension of the body by the user).

FIG. 4*h* depicts the current exercise position (third graphic symbol P3) coinciding with an intermediate position between the first initial exercise position (first graphic element P1) of the set range of motion ROM of the user and the second end exercise position (second graphic element P2) of the set range of motion ROM of the user (repetition being executed without yet having reached the maximum extension of the body by the user).

FIG. 4*i* depicts the current exercise position (third graphic symbol P3) coinciding with the second end exercise position (second graphic element P2) of the set range of motion ROM of the user (repetition being executed with the maximum extension of the body reached by the user).

Figure 5:
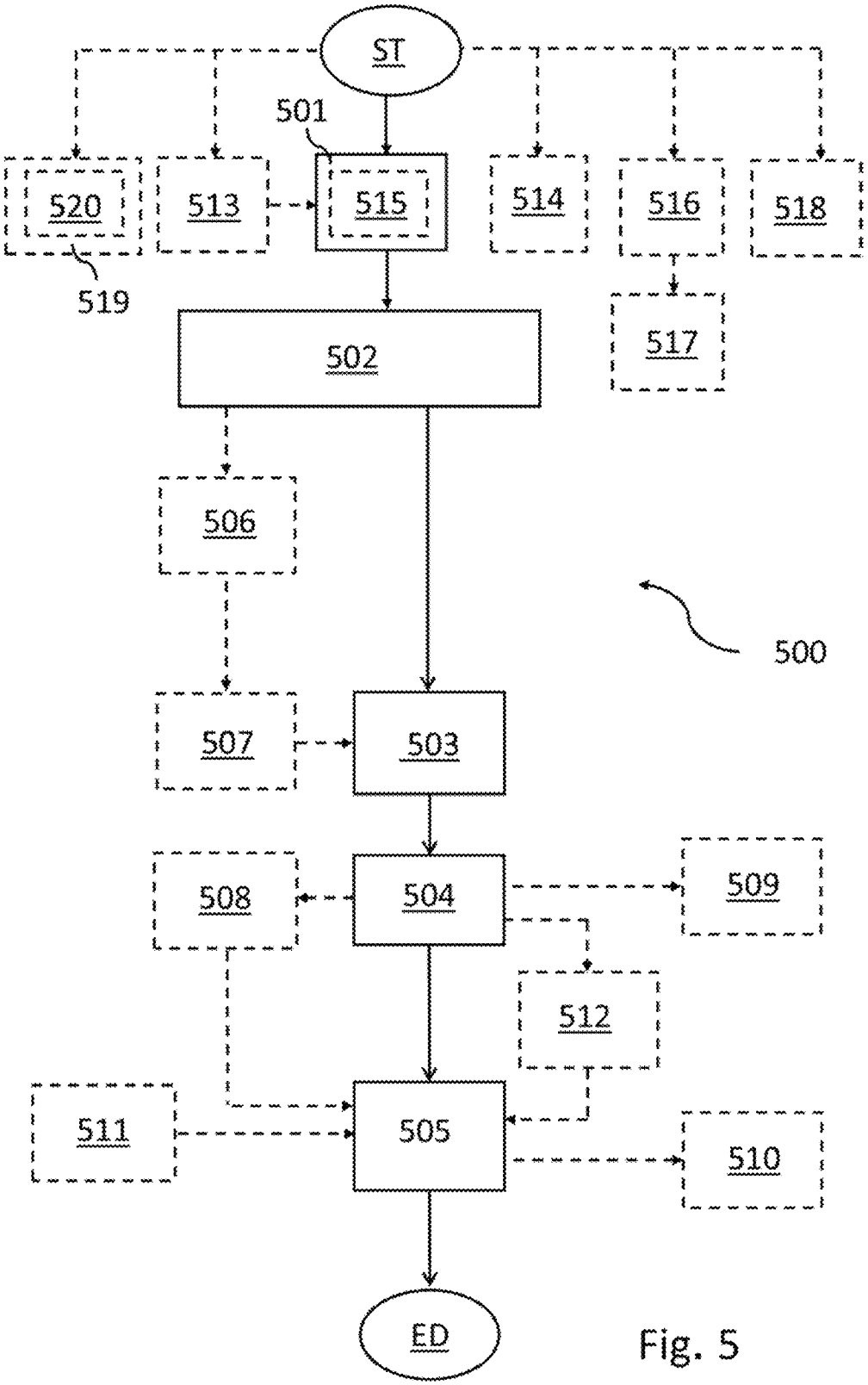
FIG. 5 diagrammatically shows, by means of a block diagram, a method for controlling exercise load variations in a strength exercise machine according to the present invention.

A method 500 for controlling exercise load variations in a strength exercise machine 100 during a workout using the stripping technique, hereinafter also referred to as control method 500 or simply method 500, according to an embodiment of the present invention, will now be described with reference to FIG. 5.

The strength exercise machine 100 was described above according to different embodiments.

The method 500 comprises a symbolic step of starting ST.

The method 500 comprises, at a current time instant $t_i$ of a plurality of successive time instants $t_1, t_2, \ldots, t_N$, where $1<i<N$, a step of s1) detecting 501, by a data processing unit 3 of the strength exercise machine 100, an exercise position within a set range of motion of the user.

The exercise position within a set range of motion of the user has already been described above.

The method 500 further comprises, again at the current time instant $t_i$ of a plurality of successive time instants $t_1, t_2, \ldots, t_N$, where $1<i<N$, a step of s2) checking 502, by the data processing unit 3 of the strength exercise machine 100, if a previously set trigger condition of an exercise load variation comprises the detected exercise position of the user within the set range of motion.

Examples of trigger conditions were described above.

If a previously set trigger condition of an exercise load variation comprises the detected exercise position of the user within the respective range of motion, the method 500 comprises, again at the current time instant $t_i$ of a plurality of successive time instants $t_1, t_2, \ldots, t_N$, where $1<i<N$, a step of s3) setting 503, by the data processing unit 3 of the strength exercise machine 100, such a trigger condition of an exercise load variation as the current trigger condition of exercise load variation.

Such a trigger condition of an exercise load variation comprises at least one respective first speed threshold for the execution of the motion by the user.

The speed for the execution of the motion by the user was described above.

The method 500, again at the current time instant $t_i$ of a plurality of successive time instants $t_1, t_2, \ldots, t_N$, where $1<i<N$, comprises a step of s4) comparing 504, by the data processing unit 3 of the strength exercise machine 100, a speed for the execution of the motion by the user at the current time instant $t_i$ with the first speed threshold for the execution of the motion by the user comprised in the current trigger condition of exercise load variation.

If the speed for the execution of the motion by the user is either less than or equal to the first execution speed threshold, the method 500, again at the current time instant $t_i$ of a plurality of successive time instants $t_1, t_2, \ldots, t_N$, where $1<i<N$, comprises a step of s5) reducing 505, by the data processing unit 3 of the strength exercise machine 100, the exercise load by a set exercise load variation associated with the number of exercise load variations executed by the data processing unit 3 of the strength exercise machine 100 up to the current time instant $t_i$.

According to an embodiment, in combination with the preceding one and depicted in dashed lines in FIG. 5, the method 500, again at the current time instant $t_i$ of a plurality of successive time instants $t_1, t_2, \ldots, t_N$, where $1<i<N$, further comprises a step of s6) detecting 506, by the data processing unit 3 of the strength exercise machine 100, a direction of motion of the user during the exercise.

The direction of motion of the user during the exercise has already been described above.

In this embodiment, the method 500, again at the current time instant $t_i$ of a plurality of successive time instants $t_1, t_2, \ldots, t_N$, where $1<i<N$, comprises a step of s7) checking 507, by the data processing unit 3 of the strength exercise machine 100, if the previously set trigger condition of an exercise load variation further comprises the detected direction of motion of the user during the exercise.

In this embodiment, the step of s3) setting 503 is executed, by the data processing unit 3 of the strength exercise machine 100, if the previously set trigger condition of an exercise load variation comprising the detected exercise position of the user within the respective range of motion further comprises the detected direction of motion of the user during the exercise.

In an embodiment, according to any of those described above, the trigger condition of a current exercise load variation further comprises at least one respective second time threshold.

In this embodiment, shown in dashed lines in FIG. 5, the method 500, again at the current time instant $t_i$ of a plurality of successive time instants $t_1, t_2, \ldots, t_N$, where $1<i<N$, comprises, if the speed for the execution of the motion by the user is either less than or equal to the first execution speed threshold, a step of s8) checking 508, by the data processing unit 3 of the strength exercise machine 100, how much time the speed for the execution of the motion by the user is either less than or equal to the first execution speed threshold by comparing a first comparison time interval between the current time instant $t_i$ and a last preceding time instant $t_{i-k}$, $0<k<i$, where the trigger condition for which the speed for the execution of the motion by the user is either less than or equal to the first execution speed threshold is not met, with a second reference time interval with a duration equal to the second time threshold of the trigger condition.

In this embodiment, the step of s5) reducing 505 is executed, by the data processing unit 3 of the strength exercise machine 100, if the speed for the execution of the motion by the user is either less than or equal to the first execution speed threshold and the first comparison time interval between the current time instant $t_i$ and the last preceding time instant $t_{i-k}$, $0<k<i$ is either greater than or equal to the second time interval with a duration equal to the second time threshold of the trigger condition.

In this regard, examples of trigger conditions were described above.

According to an embodiment, in combination with the preceding one and shown in dashed lines in FIG. 5, the method 500, again at the current time instant t of a plurality of successive time instants $t_1, t_2, \ldots, t_N$, where $1<i<N$, comprises, if the first comparison time interval is either greater than or equal to the second reference time interval with a duration equal to the second time threshold of the trigger condition, a step of s9) comparing 509, by the data processing unit 3 of the strength exercise machine 100, the number of repetitions executed by the user up to the current time instant $t_i$ with a number of repetitions corresponding to the last executed load variation.

In this embodiment, if the number of repetitions executed by the user up to the current time instant $t_i$ is greater than the number of repetitions corresponding to the last executed load variation, the method 500, again at the current time instant $t_i$ of a plurality of successive time instants $t_1, t_2, \ldots, t_N$, where $1<i<N$, comprises a step of s10) updating 510, by the data processing unit 3 of the strength exercise machine 100, the number of repetitions corresponding to the last load variation executed with the number of repetitions executed by the user up to the current time instant $t_i$.

In an embodiment, in combination with the preceding one and shown in dashed lines in FIG. 5, the method 500, again at the current time instant $t_i$ of a plurality of successive time instants $t_1, t_2, \ldots, t_N$, where $1<i<N$, further comprises a step of s11) comparing 511, by the data processing unit 3 of the strength exercise machine 100, the number of exercise load variations executed up to the current time instant $t_i$ with a number of exercise load variations to be executed.

In this embodiment, the step of s5) reducing 505 is executed, by the data processing unit 3 of the strength exercise machine 100, if the number of exercise load variations executed up to the current time instant $t_i$ is less than the number of exercise load variations to be executed.

In an embodiment, in combination with the preceding one and shown in dashed lines in FIG. 5, the method 500, again at the current time instant $t_i$ of a plurality of successive time instants $t_1, t_2, \ldots, t_N$, where $1<i<N$, comprises, if the number of repetitions executed by the user up to the current time instant $t_i$ is equal to the number of repetitions corresponding to the last load variation executed, a step of s12) comparing 512, by the data processing unit 3 of the strength exercise machine 100, a further first comparison time interval between the current time instant $t_i$ and a last preceding time instant $t_{i-k}$, $0<k<i$, with a limit value representative of the maximum time that a trigger condition of an exercise load variation may exist before an exercise load variation occurs.

In this embodiment, the step of s5) reducing 505 is executed by the data processing unit 3 of the strength exercise machine 100, if the further first comparison time interval is either greater than or equal to the limit value representative of the maximum time that a trigger condition of an exercise load variation may exist before an exercise load variation occurs.

In an embodiment, in combination with any of those described above and shown in dashed lines in FIG. 5, the method 500, again at the current time instant $t_i$ of a plurality of successive time instants $t_1, t_2, \ldots, t_N$, where $1<i<N$, comprises a step of s13) comparing 513, by the data processing unit 3 of the strength exercise machine 100, the current exercise load with the preceding exercise load detected at a preceding time instant $t_{i-1}$ with respect to the current time instant $t_i$.

In this embodiment, the method 500 is executed, by the data processing unit 3 of the strength exercise machine 100, starting from the step of s1) detecting 501 if the preceding exercise load is equal to the current exercise load.

In an embodiment, in combination with the preceding one and shown in dashed lines in FIG. 5, the method 500, again at the current time instant $t_i$ of a plurality of successive time instants $t_1, t_2, \ldots, t_N$, where $1<i<N$, comprises a step of s14) increasing 514, by the data processing unit 3 of the strength exercise machine 100, the exercise load by a set quantity as a function of a set increase rule.

It is worth noting that the step of s14) increasing 514 is executed by the data processing unit 3 of the strength exercise machine 100 only before executing the first exercise load reduction by a set exercise load variation. From that point forward, the data processing unit 3 executes the exercise load variation control as described above according to various embodiments.

According to an embodiment, in combination with the preceding one, the set increase rule provides for increasing the exercise load by the set quantity at the beginning of each repetition or at the beginning of each set time interval (e.g. every 10 seconds).

In an embodiment, in combination with any of the preceding ones and shown in dashed lines in FIG. 5, again at the current time instant $t_i$ of a plurality of successive time instants $t_1, t_2, \ldots, t_N$, where $1<i<N$, the step of s1) detecting 501 comprises a step of s15) defining 515, by the data processing unit 3 of the strength exercise machine 100, the exercise position of the user within the set range of motion of the user as a percentage of the set range of motion of the user.

In an embodiment, in combination with any of the preceding ones and shown in dashed lines in FIG. 5, the method 500, again at the current time instant $t_i$ of a plurality of successive time instants $t_1, t_2, \ldots, t_N$, where $1<i<N$, comprises a step of s16) acquiring 516, by the data processing unit 3 of the strength exercise machine 100, a first parameter representative of a Range Of Motion (ROM) of the user on that strength exercise machine 100 and a second parameter representative of a maximum load which can be moved by the user in a single repetition or 1RM (1-Repetition Maximum).

In an embodiment, in combination with the preceding one and shown in dashed lines in FIG. 5, the method 500, again at the current time instant $t_i$ of a plurality of successive time instants $t_1, t_2, \ldots, t_N$, where $1<i<N$, comprises a step of s17) defining 517, by the data processing unit 3 of the strength exercise machine 100, an initial exercise load value.

In this embodiment, the initial exercise load value is defined as a percentage of the first parameter representative of a maximum load which may be moved by the user in a single repetition.

According to a further embodiment, in combination with any of the preceding ones and shown in dashed lines in FIG. 5, the method 500, again at the current time instant $t_i$ of a plurality of successive time instants $t_1, t_2, \ldots, t_N$, where $1<i<N$, comprises a step of s18) setting 518, by the data processing unit 3 of the strength exercise machine 100, initial exercise parameters of the user.

Such initial parameters comprise:

- a maximum number of exercise load variations which may be executed, e.g., 3;
- a set exercise load variation to be executed when a trigger condition of an exercise load variation occurs, e.g., a reduction of 20% of the current working load; such a set exercise load variation being fixed or variable at each reduction to be executed;
- a number of repetition series to be executed, e.g., 2; and
- a recovery time between one repetition and the successive one, e.g., 2 minutes.

According to a further embodiment, in combination with any of the preceding ones and shown in dashed lines in FIG. 5, the method 500, again at the current time instant $t_i$ of a plurality of successive time instants $t_1, t_2, \ldots, t_N$, where $1<i<N$, comprises a step of s19) displaying 519, by the data processing unit 3 of the strength exercise machine 100 on a display module 7 of the strength exercise machine 100, graphic screens representative of the exercise being executed by the user.

According to an embodiment, in combination with the preceding one, the step of s19) displaying 519 comprises a step of s20) providing 520, by the data processing unit 3 of the strength exercise machine 100, graphic animations of such graphic screens while executing the method of controlling an exercise load variation.

With reference again to FIG. 5, the method 500 further comprises a symbolic step of ending ED.

An example of implementation of the method for controlling exercise load variations in a strength exercise machine according to the present invention is described referring now to FIGS. 1, 4*a*-4*i*.

The user sits on the seat of the strength exercise machine 100 and logs in using the user interface 6.

The data processing unit 3 of the strength exercise machine 100 acquires a first parameter representative of a Range Of Motion (ROM) of the user on that strength exercise machine 100 and a second parameter representative of a maximum load which can be moved by the user in a single repetition or 1RM (1-Repetition Maximum).

The data processing unit 3 of the strength exercise machines 100 defines an initial exercise load value as a percentage of the first parameter representative of a maximum load which may be moved by the user in a single repetition.

Furthermore, the data processing unit 3 of the strength exercise machine 100 sets the initial exercise parameters of the user, and in particular:

- a maximum number of exercise load variations which may be executed, e.g., 3;
- a set exercise load variation to be executed when a trigger condition of an exercise load variation occurs, e.g., a reduction of 20% of the current working load;
- a number of repetition series to be executed, e.g., 2; and
- a recovery time between one repetition and the successive one, e.g., 2 minutes.

The user starts the exercise using the initial exercise load, e.g., 75 kg, set by data processing unit 3 as the current exercise load (FIG. 4*a*).

The second indicator V2 of the movable bar BM comprises the whole plurality of graphic elements, corresponding to the maximum number of executable exercise load variations (three) colored in the same first color (gray) because no exercise load variation has yet been ordered by the data processing unit 3 (FIG. 4*a*).

The first indicator V1 comprises instead the whole plurality of graphic elements, corresponding to the maximum number of executable exercise load variations (three) colored in the same second color (white) because no exercise load variation has yet been ordered by the data processing unit 3 (FIG. 4*a*).

The user, at each repetition, executes a concentric motion, in which the current exercise position (third graphic symbol P3) switches from the first initial exercise position (first graphic element P1) of the set range of motion ROM of the user (repetition start without yet any extension of the body by the user) (FIG. 4*a*), e.g., switching from an intermediate position between the first initial exercise position (first graphic element P1) of the set range of motion ROM of the user and the second end exercise position (second graphic element P2) of the set range of motion ROM of the user (repetition being executed without yet having reached the maximum extension of the body by the user) (FIG. 4*b*) up to the second end exercise position of the set range of motion ROM of the user (repetition being executed with the maximum extension of the body reached by the user) (FIG. 4*c*).

The user, once having reached the second end exercise position of the set range of motion ROM of the user, executes an eccentric motion to take the current exercise position to the first initial exercise position (first graphic element P1) of the set range of motion ROM of the user (FIG. 4*a*).

During the execution of these repetitions by the user, the data processing unit 3 of the strength exercise machine 100 detects an exercise position within a set range of motion of the user and checks if a previously set trigger condition of as exercise load variation comprises the exercise position of the user within the detected set range of motion.

If a previously set trigger condition of an exercise load variation comprises the exercise position of the user within the respective range of motion detected by the data processing unit 3 of the strength exercise machine 100, the data processing unit 3 of the strength exercise machine 100 sets such a trigger condition of an exercise load variation as the current trigger condition of exercise load variation.

Such a trigger condition of an exercise load variation comprises at least one respective first speed threshold for the execution of the motion by the user.

The data processing unit 3 of the strength exercise machine 100 compares the speed for the execution of the motion by the user at the current time instant $t_i$ with the first speed threshold for the execution of the motion by the user comprised in the current trigger condition of exercise load variation, and if the speed for the execution of the motion by the user is either less than or equal to the first execution speed threshold, reduces the exercise load of a set exercise load variation associated with the number of exercise load variations executed by the data processing unit 3 of the strength exercise machine 100 up to the preceding time instant $t_{i-1}$.

Reducing the preceding exercise load by a set exercise load variation, e.g., 5 kg, on command of the data processing unit 3 when a trigger condition occurs, the current exercise load becomes of 70 kg, for example (FIG. 4*d*).

The second indicator V2 of the movable bar BM comprises the plurality of graphic elements corresponding to the maximum number of executable exercise load variations (three) in which a first portion of graphic elements (in this case, two graphic elements) is colored in the first color (e.g., gray) while a second portion (in this case, one) is colored in the second color (white) because a reduction of the preceding exercise load by a set exercise load variation of 5 kg, in this example, has been ordered by the data processing unit 3, taking the current exercise load to the value of 70 kg (FIG. 4*d*).

The first indicator V1 comprises instead the plurality of graphic elements corresponding to the maximum number of executable exercise load variations (three) in which a first portion of graphic elements (in this case, two graphic elements) is colored in the second color (white) while a second portion (one) is colored in the first color (white) because a reduction of the preceding exercise load by a set exercise load venation of 5 kg, in this example, has been ordered by the data processing unit 3, taking the current exercise load to the value of 70 kg (FIG. 4*d*).

The user executes each repetition having 70 kg as the current exercise load, as shown in FIGS. 4*d*-4*f* (sequence already described above with reference to FIGS. 4*a*-4*c*).

In the meantime, the data processing unit 3 of the strength exercise machine 100 continues to execute the method for controlling load exercise variations and, if a trigger condition still occurs, orders the current exercise load reduction by a set current exercise load variation (5 kg).

Having consumed the maximum number of executable load exercise variations, i.e., three, the user will execute repetitions with a current exercise load of 60 kg, as shown in FIGS. 4*g*-4*i*.

The second indicator V2 of the movable bar BM comprises the plurality of graphic elements, corresponding to the maximum number of executable exercise load variations (three) in which all graphic elements are colored in the second color (white) because a reduction of the preceding exercise load by a first and a second further set exercise load variation was ordered by the data processing unit 3 equal to 5 kg, for a total of 10 kg, taking the current exercise load to the value of 60 kg, consuming the maximum number of executable exercise load variations.

The first indicator V1 instead comprises the plurality of graphic elements, corresponding to the maximum number of executable exercise load variations (e.g., three), in which all graphic elements are colored in the second color (e.g., white) because a reduction of the preceding exercise load by a first and a second further set exercise load variation was ordered by the data processing unit 3 equal to 5 kg, for a total of 10 kg, taking the current exercise load to the value of 60 kg, consuming the maximum number of executable exercise load variations.

The user executes each repetition having 60 kg as the current exercise load, as shown in FIGS. 4*g*-4*i* (sequence already described above with reference to FIGS. 4*a*-4*c*).

It is worth noting that the object of the invention is fully achieved.

Indeed, the method and the respective exercise machine of the present invention allow obtaining the reduction of the exercise load required in a strength training exercise, e.g. if executed using the stripping technique, in a completely transparent manner for the user who will not have to physically act on the number of plates or the number of discs loaded on the barbell or the dumbbells used, avoiding the need to interrupt the exercise to vary the exercise load or require the presence of one or more users or personal trainers to assist him/her during the exercise to promptly change the exercise load whenever required or needed.

Furthermore, the method and the machine of the present invention advantageously allow varying an exercise load in a strength exercise machine in a reliable and timely manner, thus ensuring that an execution of the workout by a user is as high-performing as possible while being safe.

Those skilled in the art may make changes and adaptations to the embodiments of the method and exercise machine described above or can replace elements with others which are functionally equivalent in order to meet contingent needs without departing from the scope of the following claims. All the features described above as belonging to a possible embodiment may be implemented irrespective of the other described embodiments.

What is claimed is:

1. A method for controlling exercise load variations in a strength exercise machine, a user, on the strength exercise machine, executing an exercise moving an exercise load in a number of repetitions, the method, during a workout of the user on the strength exercise machine, comprising the steps of:

s1) detecting, by a data processing unit of the strength exercise machine using a position sensor installed on the strength exercise machine, an exercise position within a set range of motion of the user during the workout of the user on the strength exercise machine, wherein the set range of motion includes: a first direction of motion between a start position, in which the exercise machine, upon the user's action, lifts the exercise load, and an end position, in which the user has moved the at least one movable element against the resistance given by the exercise load, and a second direction of motion between the end position and the start position, in which the exercise machine, upon the user's action, returns the exercise load to the start position;

s2) checking, by the data processing unit of the strength exercise machine, if a previously set trigger condition of an exercise load variation comprises the detected exercise position of the user within the set range of motion, the set trigger condition of an exercise load variation comprising that the exercise position of the user has a percentage value within the set range motion of the user;

if the previously set trigger condition of an exercise load variation comprises the detected exercise position of the user within a respective range of motion:

s3) setting, by the data processing unit of the strength exercise machine, the previously set trigger condition of an exercise load variation as current trigger condition of exercise load variation, said trigger condition of an exercise load variation comprising at least one respective speed threshold for execution of motion by the user;

s4) comparing, by the data processing unit of the strength exercise machine, a speed for execution of motion by the user at a current time instant with the speed threshold, said speed for execution of motion being calculated by the data processing unit based on the exercise position detected by the position sensor;

if the speed for the execution of the motion by the user is less than or equal to the speed threshold:

s5) reducing, by the data processing unit of the strength exercise machine, the exercise load of a set exercise load variation associated with a number of exercise load variations executed by the data processing unit of the strength exercise machine up to the current time instant, the exercise load being reduced during the workout of the user on the strength exercise machine;

the current trigger condition of an exercise load variation further comprising at least one respective amount of time, the method, at the current time instant, comprises, if the speed for the execution of the motion by the user is less than or equal to the speed threshold, the steps of:

s8) checking, by the data processing unit of the strength exercise machine, how much time the speed for the execution of the motion by the user is less than or equal to the speed threshold by comparing a first comparison time interval comprised between the current time instant and a last preceding time instant, wherein the trigger condition for which the speed for the execution of the motion by the user is less than or equal to the speed threshold is not met, with a second reference time interval whose duration is equal to the amount of time of the trigger condition, step s5) of reducing being performed, by the data processing unit of the strength exercise machine, if the speed for the execution of the motion by the user is less than or equal to the speed threshold and the first comparison time interval comprised between the current time instant and the last preceding time instant, is greater than or equal to the second reference time interval whose duration is equal to the amount of time of the trigger condition, if the first comparison time interval is greater than or equal to the second reference time interval whose duration is equal to the amount of time of the trigger condition, the method comprises the steps of s9) comparing, by the data processing unit of the strength exercise machine, a number of repetitions performed by the user up to the current time instant with a number of repetitions corresponding to the last load variation executed, if the number of repetitions performed by the user up to the current time instant is greater than the number of repetitions corresponding to the last load variation executed:

s10) updating, by the data processing unit of the strength exercise machine, the number of repetitions corresponding to the last load variation executed with the number of repetitions performed by the user up to the current time instant.

2. The method of claim 1, comprising the steps of:

s6) detecting, by the data processing unit of the strength exercise machine, a motion direction of the user during an exercise;

s7) checking, by the data processing unit of the strength exercise machine, if the previously set trigger condition of an exercise load variation further comprises the detected motion direction of the user during the exercise, step s3) of setting being performed, by the data processing unit of the strength exercise machine, if the previously set trigger condition of an exercise load variation comprising the detected exercise position of the user within the respective range of motion further comprises the detected motion direction of the user during the exercise.

3. The method of claim 2, the current trigger condition of an exercise load variation further comprises the at least one respective amount of time, the method, at the current time instant, comprises, if the speed for the execution of the motion by the user is less than or equal to the speed threshold, the steps of:

s8) checking, by the data processing unit of the strength exercise machine, how much time the speed for the execution of the motion by the user is less than or equal to the speed threshold by comparing a first comparison time interval comprised between the current time instant and a last preceding time instant wherein the trigger condition for which the speed for the execution of the motion by the user is less than or equal to the speed threshold is not met, with a second reference time interval whose duration is equal to the amount of time of the trigger condition, step s5) of reducing being performed, by the data processing unit of the strength exercise machine, if the speed for the execution of the motion by the user is less than or equal to the speed threshold and the first comparison time interval comprised between the current time instant and the last preceding time instant, is greater than or equal to the second reference time interval whose duration is equal to the amount of time of the trigger condition.

4. The method of claim 1, comprising a step of:

s11) comparing, by the data processing unit of the strength exercise machine, a number of exercise load variations executed up to the current time instant with a number of exercise load variations to be executed, step s5) of reducing being performed, by the data processing unit of the strength exercise machine, if the number of exercise load variations executed up to the current time instant is less than the number of exercise load variations to be executed.

5. The method of claim 1, comprising, if the number of repetitions performed by the user up to the current time instant is equal to the number of repetitions corresponding to the last load variation executed, the steps of:

s12) comparing, by the data processing unit of the strength exercise machine, a further first comparison time interval comprised between the current time instant and a last preceding time instant, with a limit value representative of the maximum time that a trigger condition of an exercise load variation may exist before an exercise load variation occurs, step s5) of reducing being performed, by the data processing unit of the strength exercise machine, if the further first comparison time interval is greater than or equal to the limit value representative of the maximum time that a trigger condition of an exercise load variation may exist before an exercise load variation occurs.

6. The method of claim 1, comprising the steps of:

s13) comparing, by the data processing unit of the strength exercise machine, a current exercise load with a preceding exercise load detected at a preceding time instant with respect to the current time instant, the method being performed, by the data processing unit of the strength exercise machine, starting from step s1) of detecting if the preceding exercise load is equal to the current exercise load.

7. The method of claim 1, comprising a step of:

s14) increasing, by the data processing unit of the strength exercise machine, an exercise load by a set quantity according to a set increase rule.

8. The method of claim 7, wherein the set increase rule provides increasing the exercise load by the set quantity at the start of each repetition or at the start of each set time interval.

9. The method of claim 1, wherein, the step s1) of detecting) comprises a step of:

s15) defining, by the data processing unit of the strength exercise machine, the exercise position of the user within the set range of motion of the user as percentage of the set range of motion of the user.

10. The method of claim 1, comprising a step of:

s16) acquiring, by the data processing unit of the strength exercise machine, a first parameter representative of a range of motion of the user on the strength exercise machine and a second parameter representative of a maximum load movable by the user in a single repetition.

11. The method of claim 10, comprising a step of:

s17) defining, by the data processing unit of the strength exercise machine, an initial exercise load value, the initial exercise load value being defined as percentage of the first parameter representative of a maximum load movable by the user in a single repetition.

12. The method of claim 1, comprising a step of:

s18) setting, by the data processing unit of the strength exercise machine, initial exercise parameters of the user, said initial parameters comprising:

a maximum number of executable exercise load variations;

a set exercise load variation to be executed when a trigger condition of an exercise load variation occurs, said set exercise load variation being fixed or variable at each reduction to be executed;

a number of repetition series to be executed;

a recovery time between one repetition and a successive one.

13. The method of claim 4, comprising, at the current time instant, if the number of repetitions performed by the user up to the current time instant is equal to the number of repetitions corresponding to the last load variation executed, the steps of:

s12) comparing, by the data processing unit of the strength exercise machine, a further first comparison time interval comprised between the current time instant and a last preceding time instant, with a limit value representative of the maximum time that a trigger condition of an exercise load variation may exist before an exercise load variation occurs, step s5) of reducing being performed, by the data processing unit of the strength exercise machine, if the further first comparison time interval is greater than or equal to the limit value representative of the maximum time that a trigger condition of an exercise load variation may exist before an exercise load variation occurs.

14. The method of claim 1, wherein the first direction of motion includes a concentric motion, and the second direction of motion includes an eccentric motion.

15. A strength exercise machine to be used by a user for executing an exercise moving an exercise load in a number of repetitions, the strength exercise machine comprising:

at least one movable element operable by a user to execute a strength exercise by moving a respective exercise load in a number of repetitions;

at least one electric motor operatively connected to said at least one movable element, the at least one electric motor being configured to exert, on the at least one movable element, a resistive force representative of an exercise load which the user may handle during execution of the strength exercise by actuating the at least one movable element;

a position sensor installed on the strength exercise machine;

a data processing unit operatively connected to said at least one electric motor, said data processing unit being configured to execute, during the workout of the user on the strength exercise machine, at a current time instant, wherein the current time instant is during the workout, the steps of:

s1) detecting an exercise position within a set range of motion of a user using the position sensor installed on the strength exercise machine, wherein the set range of motion includes: a first direction of motion between a start position, in which the exercise machine, upon the user's action, lifts the exercise load, and an end position, in which the user has moved the at least one movable element against the resistance given by the exercise load, and a second direction of motion between the end position and the start position, in which the exercise machine, upon the user's action, returns the exercise load to the start position;

s2) checking if a previously set trigger condition of an exercise load variation comprises the detected exercise position of the user within the set range of motion, the set trigger condition of an exercise load variation comprising that the exercise position of the user has a percentage value within the set range motion of the user;

if a previously set trigger condition of an exercise load variation comprises the detected exercise position of the user within a respective range of motion:

s3) setting a trigger condition of an exercise load variation as current trigger condition of exercise load variation, said trigger condition of an exercise load variation comprising at least one respective speed threshold for execution of motion by the user;

s4) comparing a speed for execution of motion by the user at the current time instant with the speed threshold for the execution of the motion by the user comprised in the current trigger condition of exercise load variation, said speed for execution of motion being calculated by the data processing unit based on the exercise position detected by the position sensor;

if the speed for the execution of the motion by the user is less than or equal to the speed threshold:

s5) reducing an exercise load of a set exercise load variation associated with a number of exercise load variations executed by the data processing unit of the strength exercise machine up to the current time instant, the exercise load being reduced during the workout of the user on the strength exercise machine;

the current trigger condition of an exercise load variation further comprising at least one respective amount of time, said data processing unit being configured to execute at the current time instant, if the speed for the execution of the motion by the user is less than or equal to the speed threshold, the steps of:

s8) checking how much time the speed for the execution of the motion by the user is less than or equal to the speed threshold by comparing a first comparison time interval comprised between the current time instant and a last preceding time instant, wherein the trigger condition for which the speed for the execution of the motion by the user is less than or equal to the speed threshold is not met, with a second reference time interval whose duration is equal to the amount of time of the trigger condition, s5) reducing being performed, by the data processing unit of the strength exercise machine, if the speed for the execution of the motion by the user is less than or equal to the speed threshold and the first comparison time interval comprised between the current time instant and the last preceding time instant, is greater than or equal to the second reference time interval whose duration is equal to the amount of time of the trigger condition, if the first comparison time interval is greater than or equal to the second reference time interval whose duration is equal to the amount of time of the trigger condition, said data processing unit of the strength exercise machine being configured to execute the steps of s9) comparing a number of repetitions performed by the user up to the current time instant with a number of repetitions corresponding to the last load variation executed, if the number of repetitions performed by the user up to the current time instant is greater than the number of repetitions corresponding to the last load variation executed:

s10) updating the number of repetitions corresponding to the last load variation executed with the number of repetitions performed by the user up to the current time instant.

16. The strength exercise machine of claim 15, wherein the first direction of motion includes a concentric motion, and the second direction of motion includes an eccentric motion.

* * * * *